US011434040B2

(12) United States Patent
Tsai et al.

(10) Patent No.: US 11,434,040 B2
(45) Date of Patent: Sep. 6, 2022

(54) CHILD-RESISTANT PACKAGING

(71) Applicant: Denali Innovations, LLC, City of Industry, CA (US)

(72) Inventors: Mike Tsai, Chino Hills, CA (US); Frank Tsai, Walnut, CA (US)

(73) Assignee: Denali Innovations, LLC, City of Industry, CA (US)

( * ) Notice: Subject to any disclaimer, the term of this patent is extended or adjusted under 35 U.S.C. 154(b) by 158 days.

(21) Appl. No.: 17/091,384

(22) Filed: Nov. 6, 2020

(65) Prior Publication Data

US 2021/0053715 A1 Feb. 25, 2021

Related U.S. Application Data

(63) Continuation of application No. 16/134,883, filed on Sep. 18, 2018, now Pat. No. 10,889,404.

(51) Int. Cl.

| | |
|---|---|
| ***B65D 5/38*** | (2006.01) |
| ***B65D 59/04*** | (2006.01) |
| ***B65D 5/44*** | (2006.01) |
| ***B65D 5/42*** | (2006.01) |

(52) U.S. Cl.

CPC ..... *B65D 5/38* (2013.01); *B65D 5/4266* (2013.01); *B65D 5/443* (2013.01); *B65D 59/04* (2013.01); *B65D 2215/02* (2013.01)

(58) Field of Classification Search

CPC ... B65D 5/38; B65D 7/10; B65D 9/08; B65D 11/12; B65D 2583/0468; B65D 2215/02; B65D 5/44

See application file for complete search history.

(56) References Cited

U.S. PATENT DOCUMENTS

| | | | | |
|---|---|---|---|---|
| 9,475,605 | B2 * | 10/2016 | Everett | B65D 59/04 |
| 2017/0217658 | A1 * | 8/2017 | Whitehurst | B65D 79/00 |
| 2019/0062023 | A1 * | 2/2019 | Lantz | B65D 75/327 |

* cited by examiner

*Primary Examiner* — Mollie Impink
(74) *Attorney, Agent, or Firm* — Kevin Schraven; Anooj Patel; Hankin Patent Law, APC

(57) ABSTRACT

A child-resistant package comprising a tray and a sleeve. The tray is configured to be inserted into said sleeve. The tray comprises external protrusions and the sleeve comprises one or more internal protrusions and access holes. The internal protrusions are configured to engage with the external protrusions when the tray and the sleeve are in a closed position, such that the tray is substantially prevented from being taken out of the closed position without disengaging the external protrusions from the internal protrusions. Each of the access holes overlaps with an end of each of the external protrusions, such that a user may access and disengage the external protrusions from the one or more internal protrusions, such that the tray is no longer prevented from being taken out of the closed position.

13 Claims, 21 Drawing Sheets

CHILD-RESISTANT PACKAGING

CROSS-REFERENCE TO RELATED APPLICATIONS

This Application is a continuation of U.S. patent application Ser. No. 16/134,883, filed on Sep. 18, 2018, titled "Child-Resistant Packaging", by inventors Mike Tsai and Frank Tsai, the contents of which are expressly incorporated herein by this reference, and to which priority is claimed.

FIELD OF USE

The present disclosure is generally relating to packages and packaging, and more particularly to child-resistant packaging.

SUMMARY OF EMBODIMENTS

Various embodiments of the present disclosure may be directed to a child-resistant package or packaging. The package may comprise an inner tray and an outer sleeve, which may matingly receive the inner tray. The outer sleeve and inner tray may have engagement portions that prevent them from being separated without disengaging the engagement portions. The engagement portions may preferably engage when the tray is entirely enclosed within the sleeve, also known as the closed position.

The inner tray, or tray, may have one or more outer protrusions. The outer sleeve, or sleeve, may have one or more inner protrusions that may matingly engage with the outer protrusions of the tray. The sleeve may have one or more access apertures or openings that allow a user to disengage the engaged protrusions. In some embodiments, the tray may have one or more space openings or apertures that substantially overlap with the one or more access apertures when the tray and sleeve are in a closed and engaged position. The one or more tray apertures allow the protrusions, or more specifically, the ends of the protrusions, to be more easily disengaged.

In some embodiments, the protrusions may be coupled to or affixed to the sleeve or tray. The coupling may be at one edge or multiple edges or may be affixed via an adhesive.

In various embodiments, the material of the child-resistant packaging may be a wood fiber paper-based product or plastic. In some embodiments the sleeve may be wood fiber paper-based and the tray may be plastic or a combination of plastic and paper. In some embodiments the sleeve, tray, and/or both may be constructed from a single foldable die-cut sheet.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps, which are illustrated. When the same numeral appears in different drawings, it refers to the same or like components or steps.

DETAILED DESCRIPTION OF THE ILLUSTRATIVE EMBODIMENTS

Figure 1:
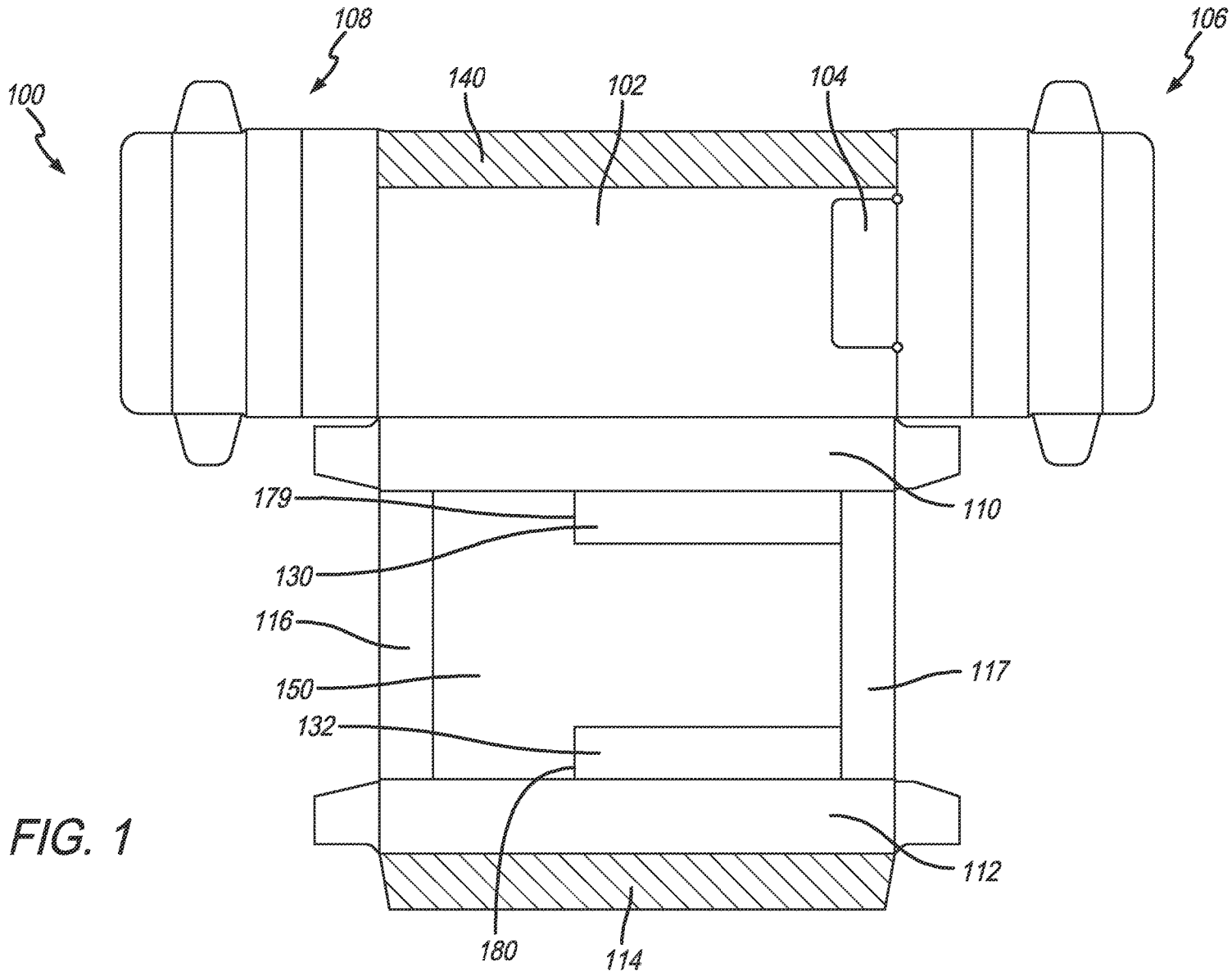
FIG. 1 is an illustration of a plan view of one embodiment of a tray flat.

Before the present methods and systems are disclosed and described, it is to be understood that the methods and systems are not limited to specific methods, specific components, or to particular implementations. It is also to be understood that the terminology used herein is for the purpose of describing particular embodiments only and is not intended to be limiting.

As is used in the specification and the appended claims, the singular forms "a," "an," and "the" include plural referents unless the context clearly dictates otherwise. Ranges expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint. In the following detailed description, numerous specific details are set forth in order to provide a thorough understanding of various aspects of one or more embodiments. However, these embodiments may be practiced without some or all of these specific details. In other instances, well-known methods, procedures, and/or components have not been described in detail so as not to unnecessarily obscure aspects of embodiments.

While multiple embodiments are disclosed, still other embodiments will become apparent to those skilled in the art from the following detailed description. As will be realized, these embodiments are capable of modifications in various obvious aspects, all without departing from the spirit and scope of protection. Accordingly, the screenshots, figures, and the detailed descriptions thereof, are to be regarded as illustrative in nature and not restrictive. Also, the reference or non-reference to a particular embodiment shall not be interpreted to limit the scope of protection.

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 15% of the indicated number or range of numbers. In one embodiment, the term "approximately" and "about", refer to a deviance of between 0.0001-40% from the indicated number or range of numbers.

Embodiments of the present invention will now be described, by way of example, with reference to the accompanying drawings.

FIG. 1 is an illustration of a plan view of one embodiment of a tray flat. As shown in FIG. 1, the tray may be formed from a die-cut or stamped from a flat. The flat may have a plurality of hinges, scored or perforated, which allows a user to bend the tray from flat into a three-dimensional tray. The tray 100 may have a back end 106, a front end 108, a bottom 102, a back flap 104, first side 110, top connectors 116, 117, second side 112, connecting flap 114, external protrusions 130, 132, and protrusion engagement ends 179, 180. When the tray 100 is formed into a tray shape, by folding at the hinge lines shown, the connecting flap 114 may be connected to connection area 140, usually through an adhesive.

Figure 2:
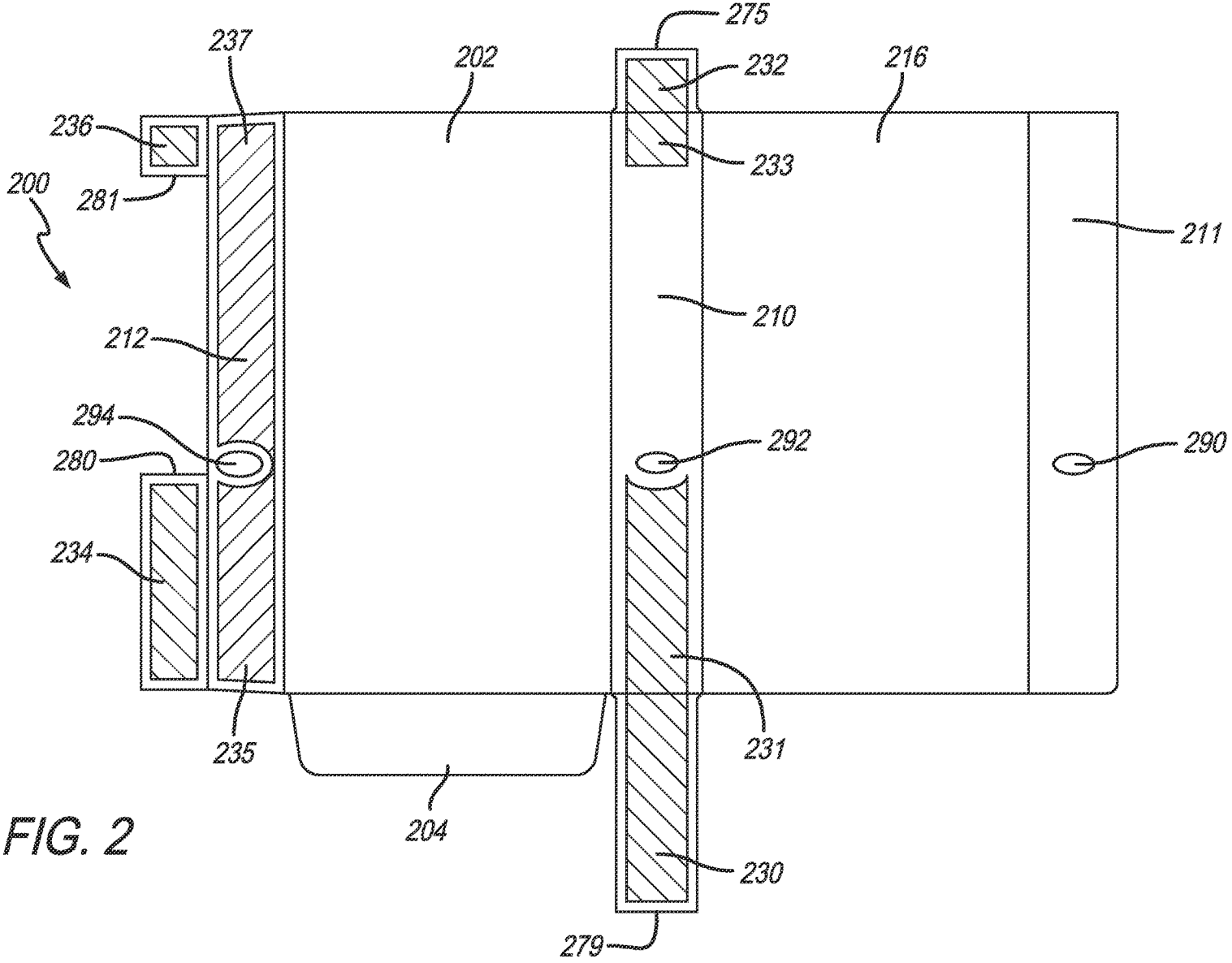
FIG. 2 is an illustration of a plan view of one embodiment of a sleeve flat.

FIG. 2 is an illustration of a plan view of one embodiment of a sleeve flat. As shown, the sleeve may be formed from a die-cut or stamped from a flat. The flat may have a plurality of hinges, scored or perforated, which allows a user to bend the sleeve from flat into a three-dimensional sleeve. The sleeve 200 may have a bottom 202, front flap 204, first side 210, second sides 211, 212, top 216, internal protrusions 230, 234, secondary internal protrusions 232, 236, access holes 290, 292, 294, internal protrusion ends, 275, 279, 280. When sleeve 200 is formed into a 3D sleeve shape, the second sides 211 and 212 are overlapped and connected together, usually through an adhesive. Access holes 290 and 294, which are sometimes referred to as openings or holes, are also preferably overlapped. Although sleeve 200 is shown as being assembled from a flat, the sleeve may be constructed in other ways. In one embodiment, the internal protrusion 230 may be glued to area 231, internal protrusion 234 may be clued to area 235, and secondary internal protrusions 232, 236 may be glued to area 233, 237, respectively.

Although FIGS. 1 and 2 show that the two sets of protrusions on are on opposite sides and directly across from each other, they may be on the same side or they may be off-set on opposite sides.

Figure 3:
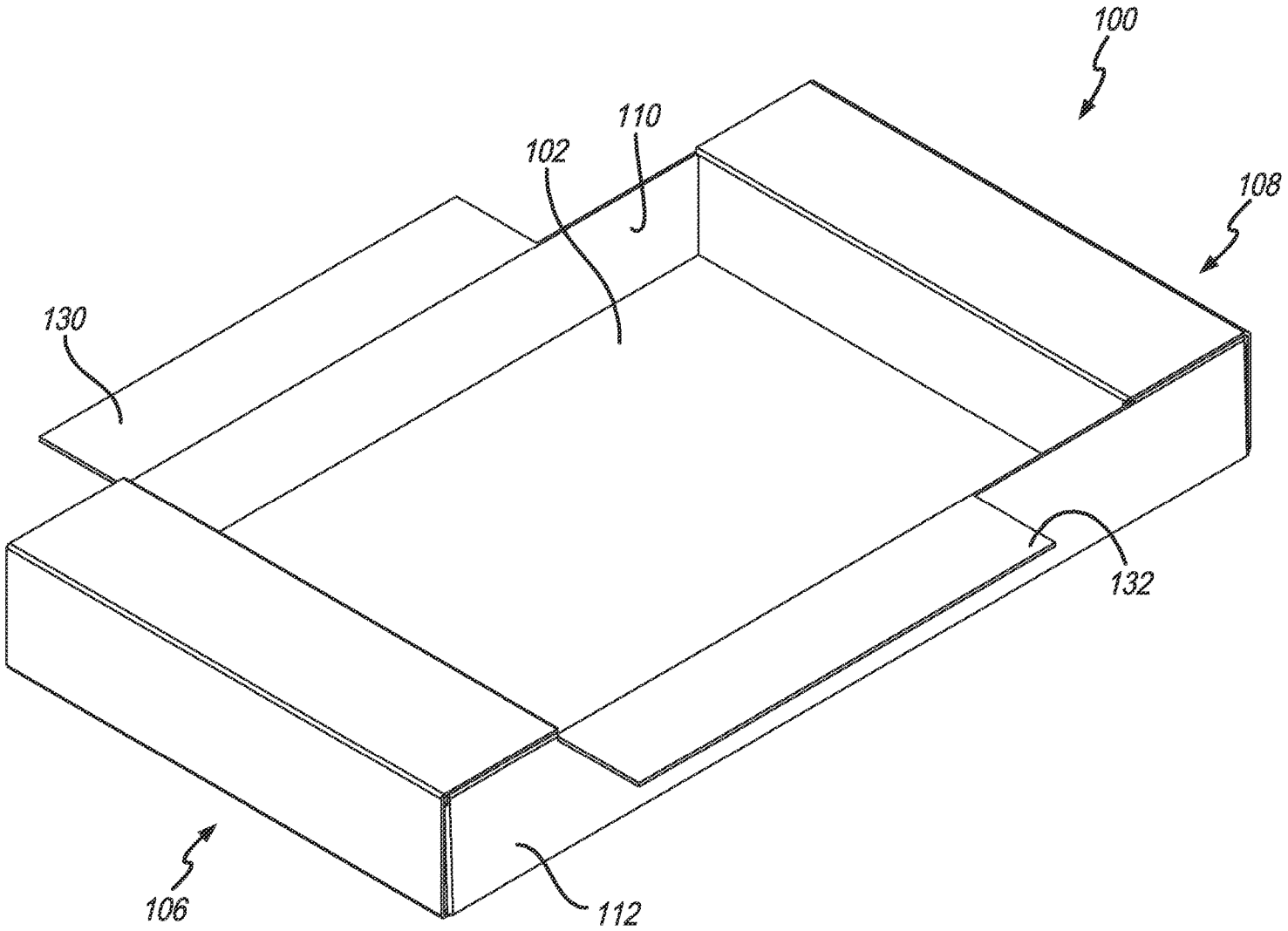
FIG. 3 is an illustration of a perspective view of one embodiment of a formed tray.

FIG. 3 is an illustration of a perspective view of one embodiment of a formed tray. FIG. 3 shows that tray 100 may comprise bottom 102, back end 106, front end 108, first side 110, second side 112, and external protrusions 130, 132. Although FIG. 3 shows that the external protrusions 130, 132 may be connected in the nature of a flap to the tray 100. When the tray 100 slides into the sleeve portion of the child-resistant package, the external protrusions 130, 132 may lay flat against the external sides of sides 110, 112, respectively. In other embodiments, the external protrusions 130, 132 may be entirely disconnected from the tray, and then adhesively attached as an external protrusion 130, 132. In another embodiment, the external protrusions 130, 132 may have varying lengths, heights, or widths, depending on the shape of the tray and sleeve and the desired resistance to opening.

The access holes 290/294 and 292 from the sleeve 200 do not engage with the external protrusions 130, 132. The access holes 290/294 and 292 in no way impede, touch, or get in the way of external protrusions 130, 132. The external protrusions 130, 132 are not configured, cannot, and do not engage with access holes 290/294 and 292, when the tray 100 is inserted into or in a closed position with sleeve 200.

Figure 4:
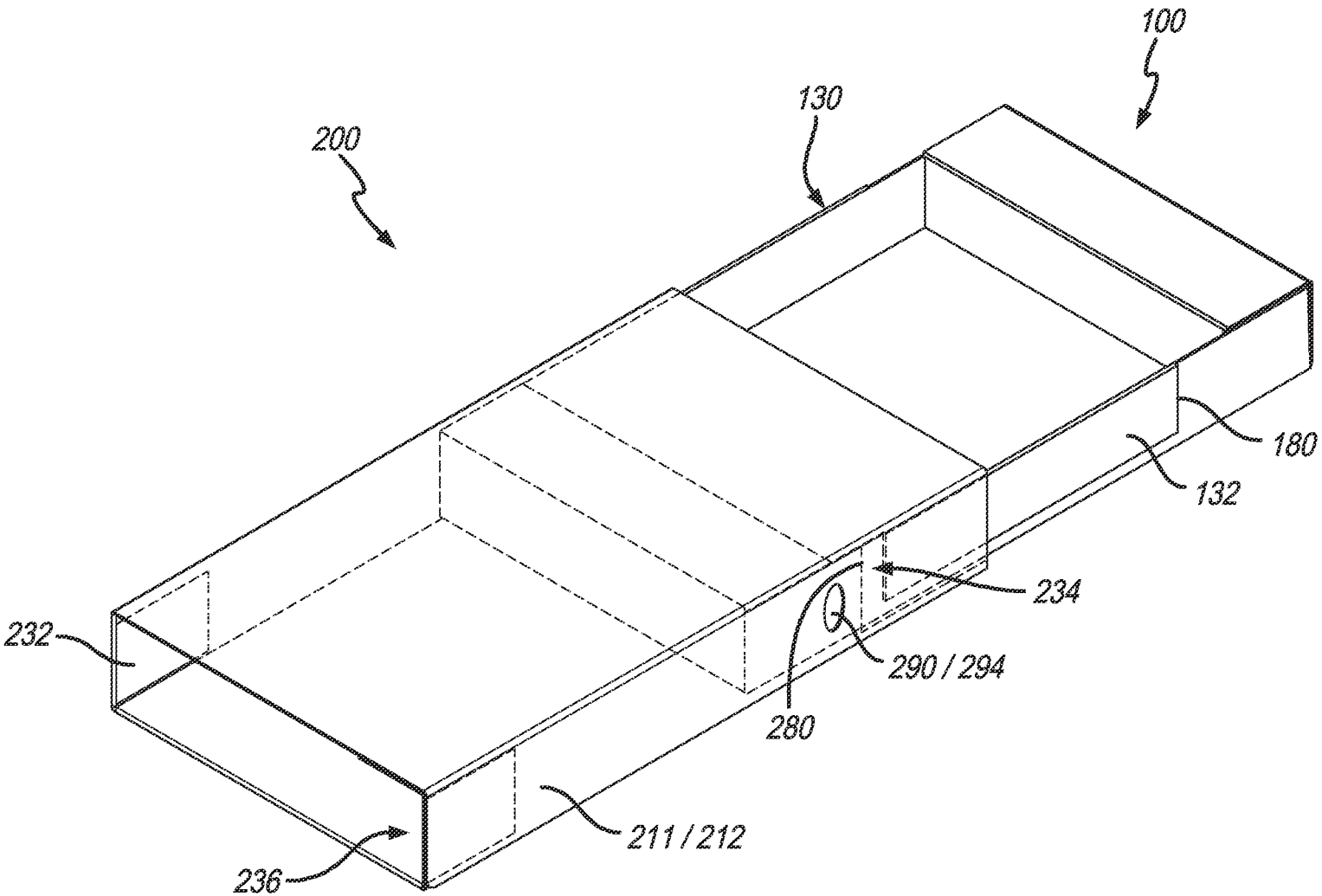
FIG. 4 is an illustration of a perspective view of one embodiment of a tray slideably engaged with a tray in a partially open position.

FIG. 4 is an illustration of a perspective view of one embodiment of a tray slideably engaged with a tray in a partially open position. FIG. 4 shows one embodiment of the child-resistant package that comprises a tray 100 and sleeve 200. The tray 100 may be configured to matingly slide into sleeve 200 such that there is at least a partially open position and a fully closed position. The sleeve 200 may have internal protrusions 232, 236 which may engage with external protrusion 130, 132 to prevent the sleeve 200 from passing out of the back end of sleeve 200. In another embodiment, the back end of sleeve 200 may have a closing flap that prevents the tray from sliding all the way through. This closing flap may have a hole that allows the user to push the end of the tray after the engaged ends of the protrusions have been disengaged.

FIG. 4 shows that the sleeve may also comprise access hole 290/294 in side 211/212, which is just adjacent to internal protrusion 234. Tray 100 may have external protrusions 130, 132, which, as shown, may be folded down when slid into sleeve 200. When the tray 100 is slid all the way into sleeve 200, the external protrusion 132 completely passes internal protrusion 234, such that end 280 and end 180 are engaged, or in a locked position), such that the tray cannot be pulled out unless the user manually disengages end 280 and end 180. In order to disengage end 280 and end 180, the user accesses and pushes end 180 so that end 180 moves to a proximal or inside position relative to external protrusion 132. On the opposite side of the container, access hole 292 allows the user to disengage end 279 of internal protrusion 230 from end 179 of external protrusion 130. In order to move, push or pull the tray into an open or partially open position, both sets of ends must be disengaged. Preferably the disengagement may be done at the same time.

Because this takes some level of dexterity and use of both hands at the same time, the container is resistant to being opened by young child.

Figure 5:
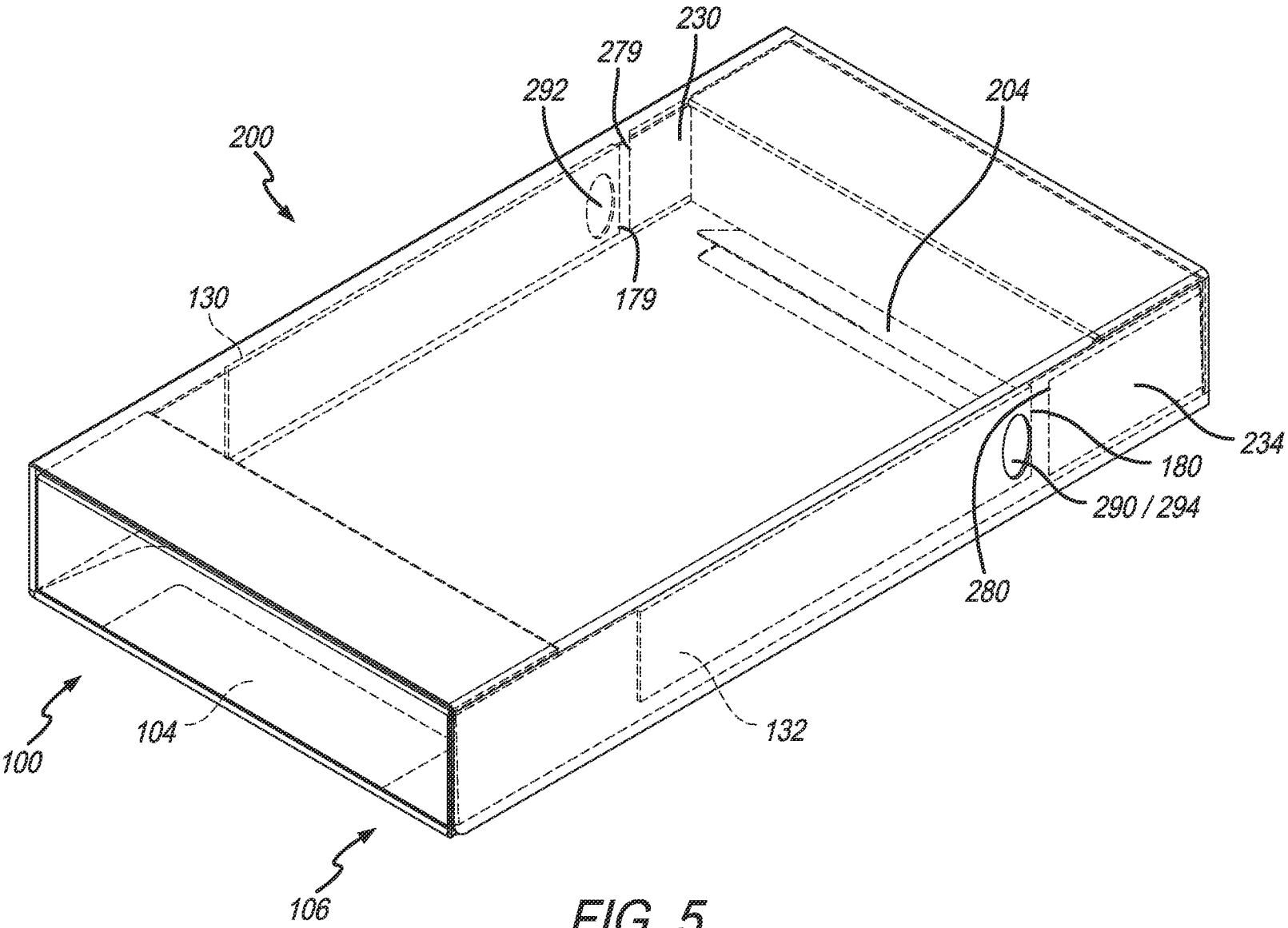
FIG. 5 is an illustration of a perspective view of one embodiment of a tray slideably engaged with a tray in a closed and locked position.

FIG. 5 is an illustration of a perspective view of one embodiment of a tray slideably engaged with a tray in a closed and locked position. The sleeve 200 and tray 100 are shown substantially as transparent in order to show the engagement of the ends of the protrusions. The sleeve 200 may comprise access hole 290/294, ends 279, 280, access hole 292, internal protrusions 230, 234, and front flap 204. The tray 100 may comprise back flap 104, back end 106, external protrusions 130, 132, and ends 179, 180. FIG. 5 shows that when the sleeve 200 and tray 100 are in a closed position, the ends 279, 280 engage with ends 179, 180 if a user attempts to pull the tray 100 out of the sleeve 200. The user may remove the tray 100 if ends 179, 180 are pushed inward so that protrusions 130, 132 may pass protrusions 230, 234. In order to allow the user to push protrusions 130, 132 inward, access may be granted by access holes 292 and 290/294. After the protrusions 230, 234 are disengaged from protrusions 130, 132, the tray 100 may be slid out of sleeve 200. In order to prevent the tray 100 from completely pulling out of the sleeve 200, the front flap 204 may engage with tray back flap 104. This is desirable, because it can be difficult to put the tray 100 back into sleeve 200 if pulled completely apart.

Figure 6:
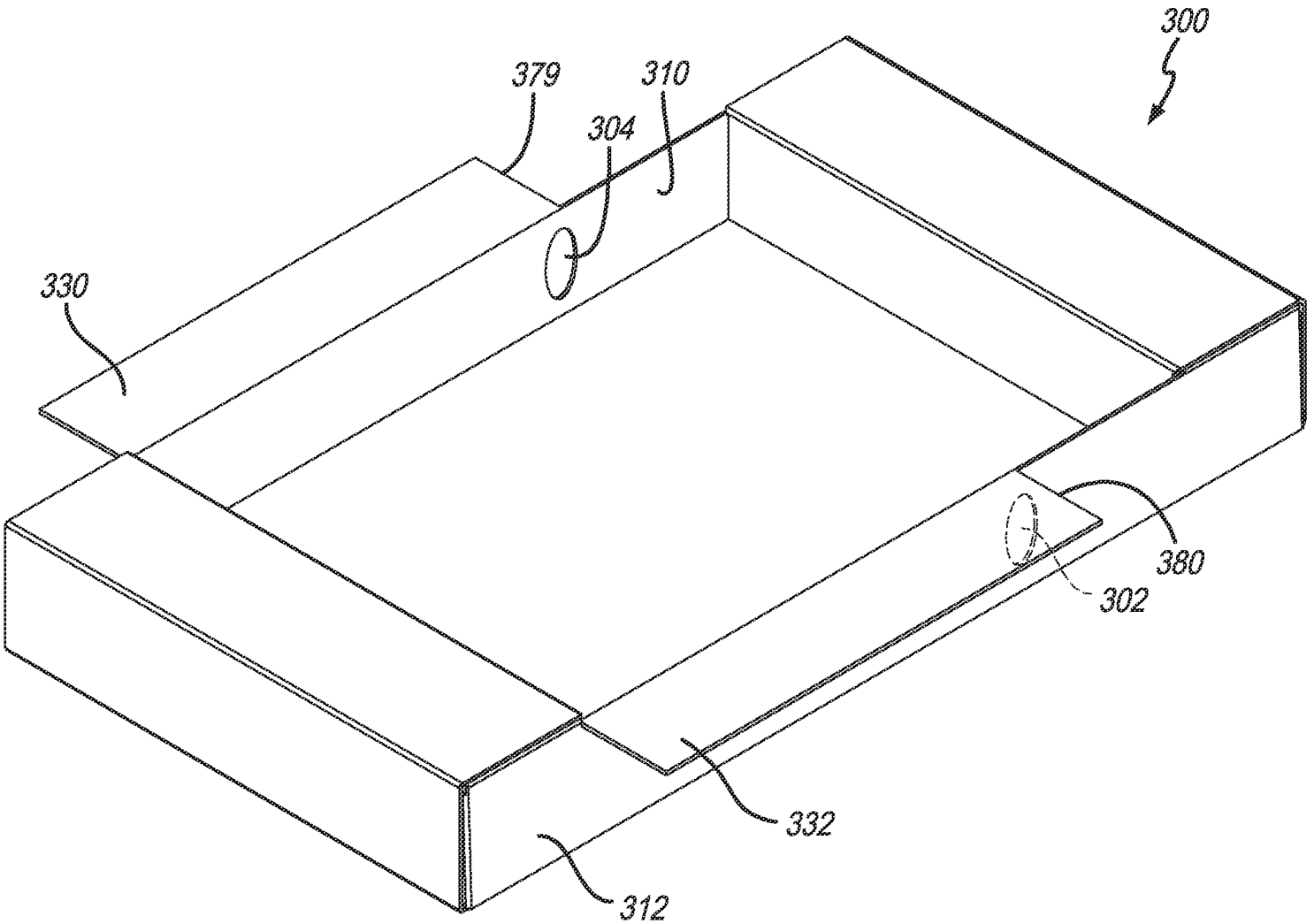
FIG. 6 is an illustration of a perspective view of another embodiment of a formed tray.

FIG. 6 is an illustration of a perspective view of another embodiment of a formed tray. FIG. 6 shows tray 300, which may comprise first side 310, second side 312, external protrusions 330, 332, ends 379, 380, and spacer holes 302, 304. The spacer holes 302, 304 allow more room for the ends 379, 380 to be deformed or pushed inward. This makes it easier to separate the tray 300 from the sleeve. Depending on the materials of which the sleeve and tray are made, rigid, thick, plastic, or paper, the spacer holes 302, 304 offer an economical way to make it easier to disengage the tray 300 from the sleeve.

FIG. 6 shows that the ends 379, 380 may be flat and sharp cornered. This makes it relatively difficult to disengage the sleeve and tray 300. The ends 379, 380 may be rounded, which would make it easier to disengage the sleeve and tray 300.

Figure 7:
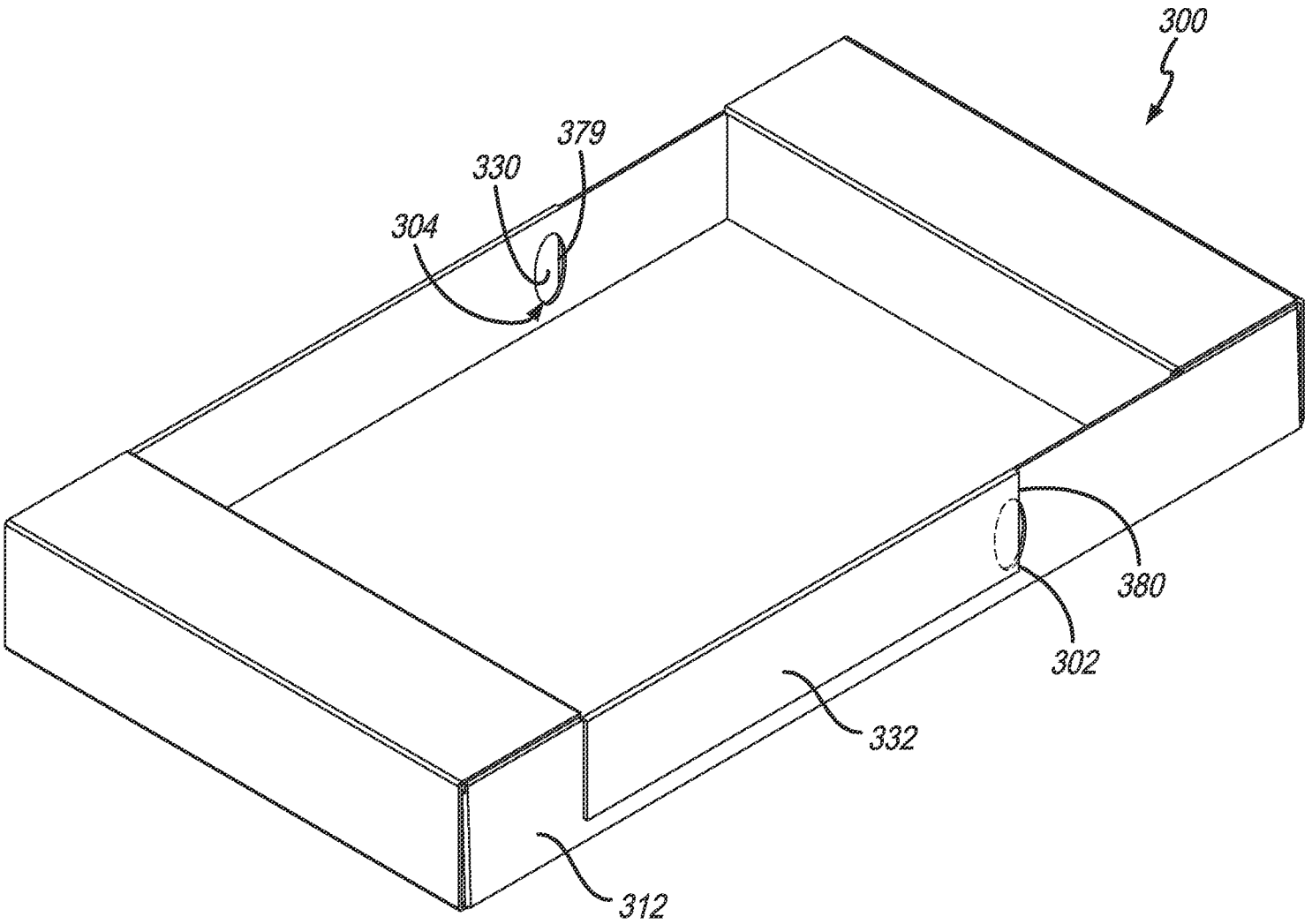
FIG. 7 is an illustration of a perspective view of the formed tray.

FIG. 7 is an illustration of a perspective view of the formed tray. FIG. 7 shows tray 300, which may comprise external protrusions 330, 332, ends 379, 380, and spacer holes 302, 304. FIG. 7 shows how the spacer holes 302, 304 allow more room for the ends 379, 380 to be deformed or pushed inward. This makes it easier to separate the tray 300 from the sleeve. In some embodiments the external protrusions may be hingedly connected to the tray 300 with some tension, which naturally pushes against the interior of the sleeve, which prevents the tray from easily being removed from the sleeve. In other embodiments, the external protrusions may be glued to the exterior of the sides of the tray.

FIG. 7 shows specifically that the ends 379, 380 may be aligned with the spacer holes 302, 304. This allows the ends 379, 380 to have more room to deform around the internal protrusions of the sleeve. Preferably the spacer holes 302, 304 are aligned with the access holes, such as access holes 290/294, 292 of sleeve 200. In this manner the ends 379, 380 are accessed where the spacer holes 302, 304 are.

Figure 8:
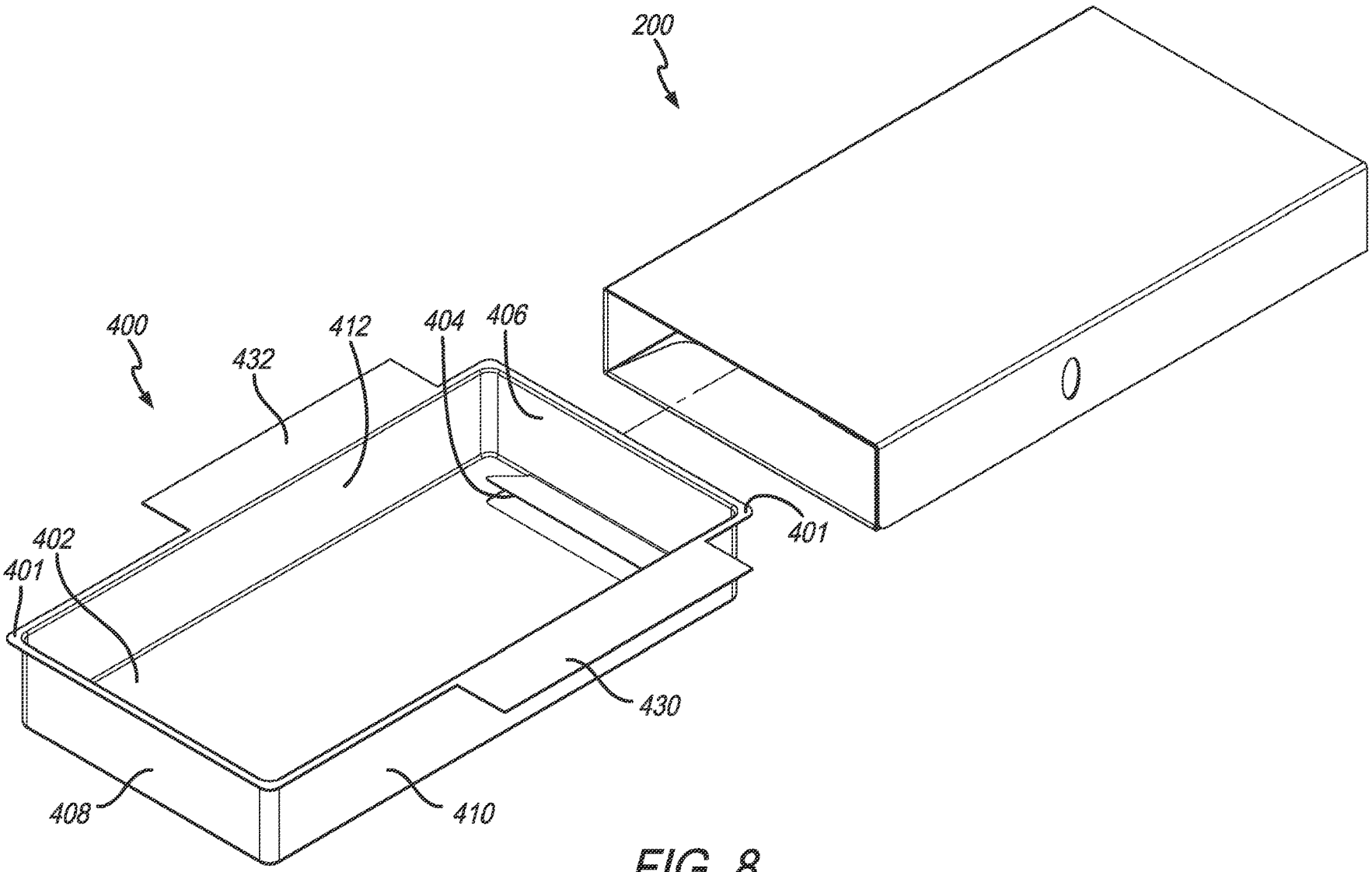
FIG. 8 is an illustration of a perspective view of one embodiment of a thermoformed tray and one embodiment of a sleeve.

FIG. 8 is an illustration of a perspective view of one embodiment of a thermoformed tray and one embodiment of a sleeve. FIG. 8 shows sleeve 200 may be configured to engage with several different embodiments of trays, including tray 400, which may comprise bottom 402, lip 401, back flap 404, back end 406, front end 408, first side 410, second side 412, and external protrusions 430, 432. FIG. 8 shows that the tray 400 may be made of plastic and is thermoformed or made by injection molding. Thermoforming is a method of manufacturing that creates products by taking a plastic sheet and heating it to a pliable forming temperature, forming it to a specific shape in a mold, and then trimming it. The sheet may be heated in an oven to a high-enough temperature that permits it to be stretched into or onto a mold and cooled to a finished shape. Other similar processes include vacuum forming. FIG. 8 shows that the tray 400 may have a lip 401 that provides further structural support and strength to the tray 400. The external protrusions 430, 432 may be hinged and folded down so that tray 400 may slide into a sleeve, such as sleeve 200.

Figure 9:
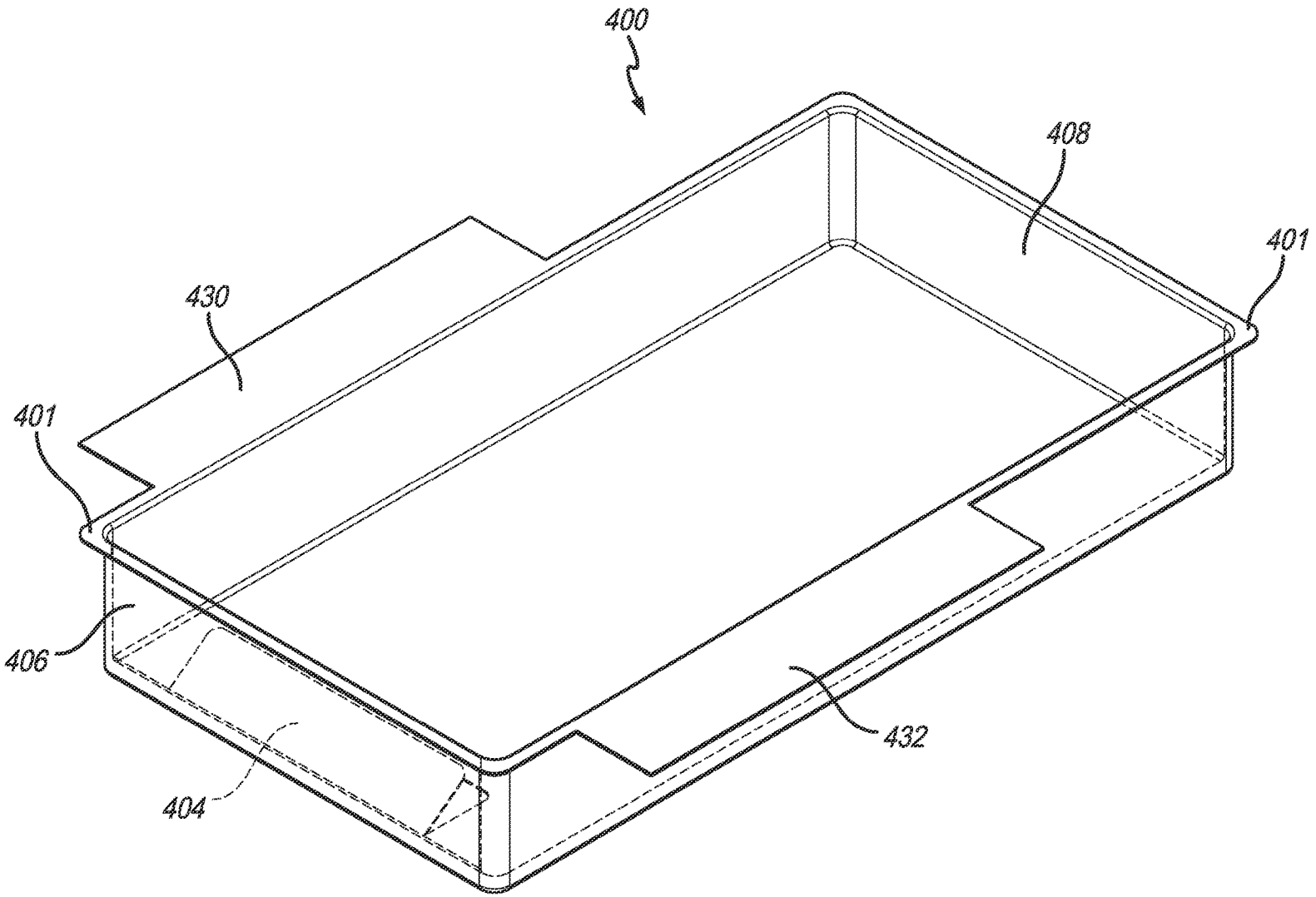
FIG. 9 is an illustration of a perspective view of the thermoformed tray.

FIG. 9 is an illustration of a perspective view of the thermoformed tray. FIG. 9 shows that tray 400 may comprise lip 401, back flap 404, back end 406, front end 408, and external protrusions 430, 432.

Figure 10:
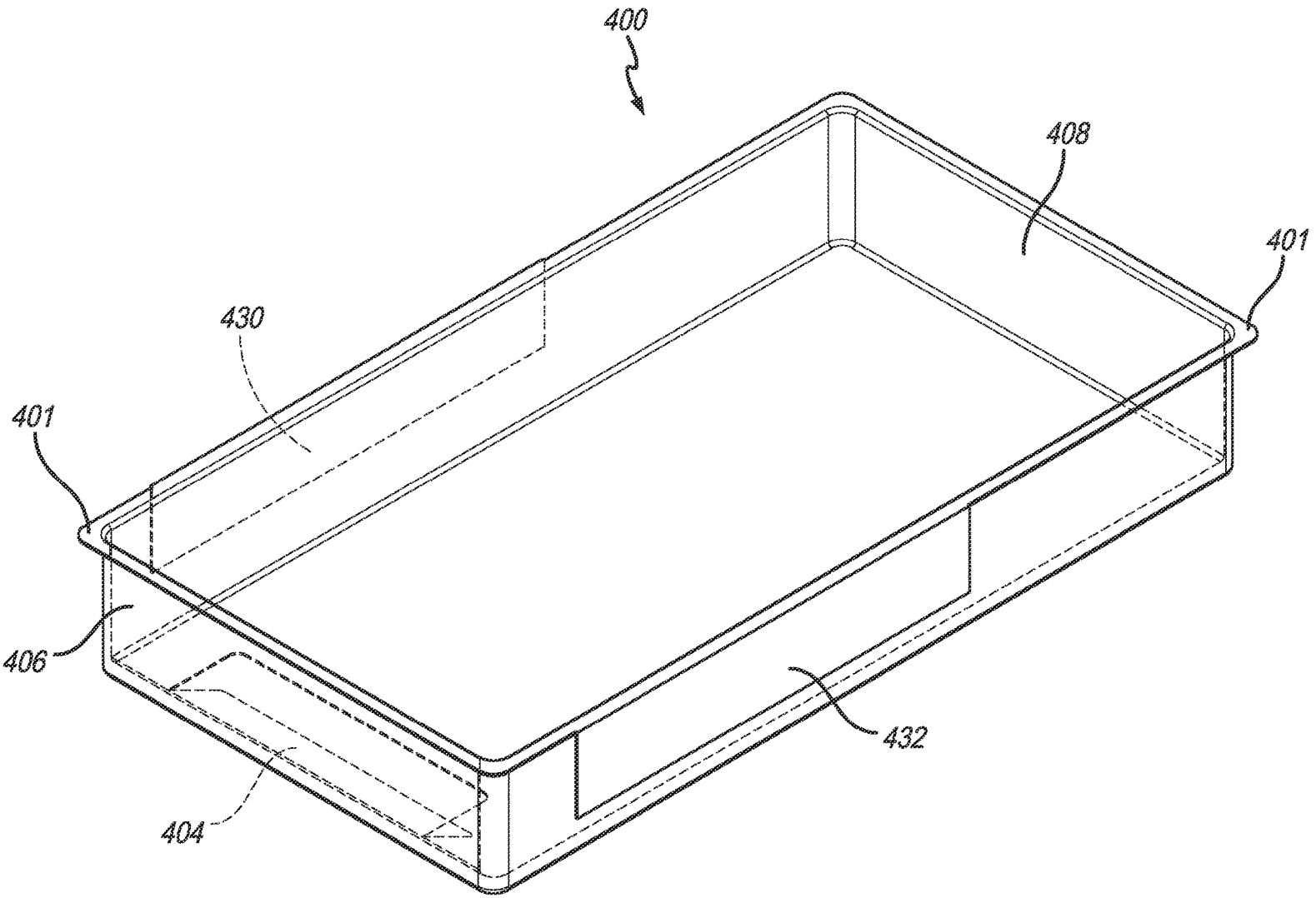
FIG. 10 is an illustration of a perspective view of the thermoformed tray.

FIG. 10 is an illustration of a perspective view of the thermoformed tray. FIG. 10 shows that tray 400 may comprise lip 401, back flap 404, back end 406, front end 408, and external protrusions 430, 432. FIG. 10 shows that the external protrusions 430, 432 may be hinged down to be in position to engage with the internal protrusions of the sleeve.

Figure 11:
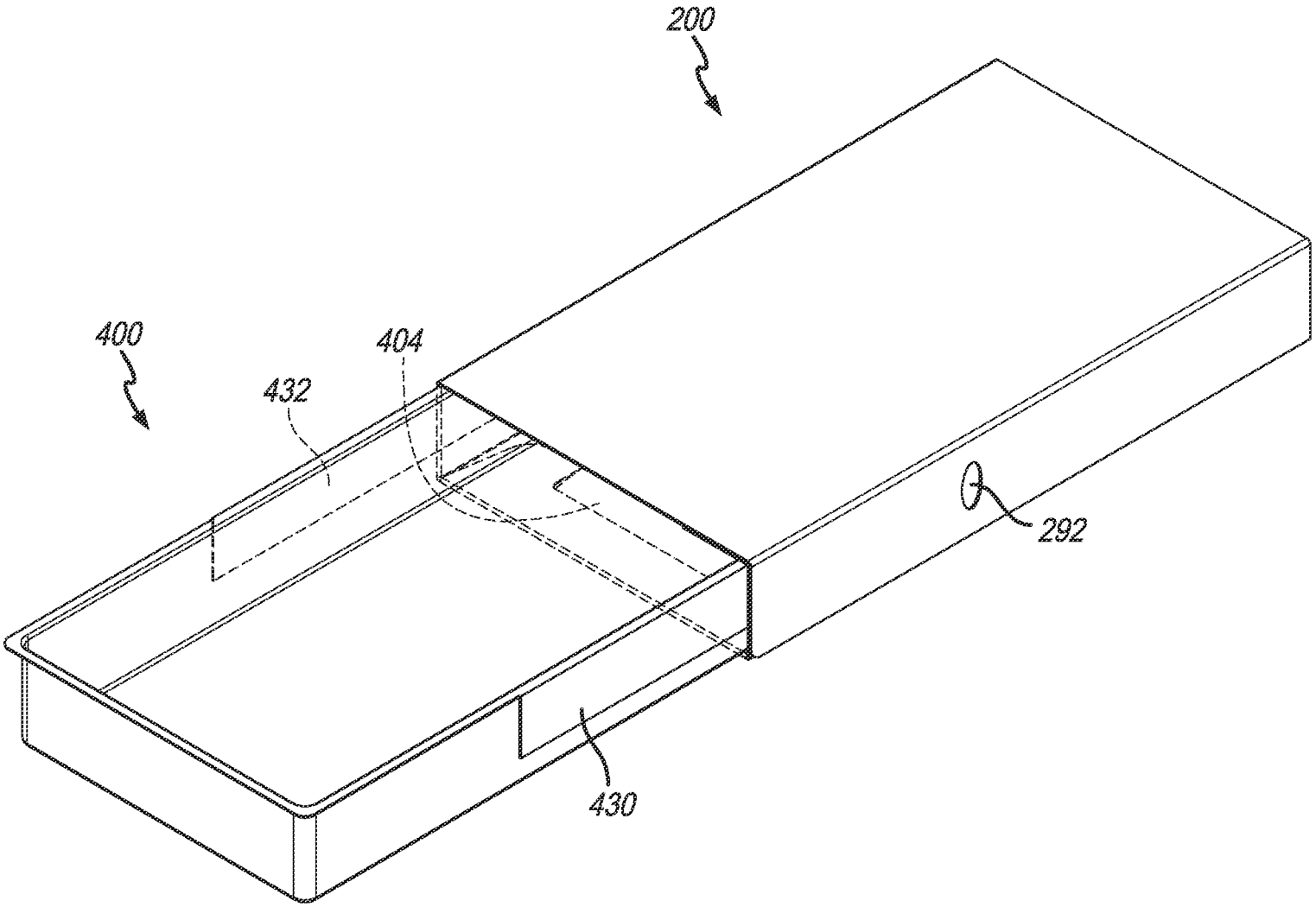
FIG. 11 is an illustration of a perspective view of the thermoformed tray partially inserted into the sleeve.

FIG. 11 is an illustration of a perspective view of the thermoformed tray partially inserted into the sleeve. FIG. 11 shows sleeve 200 may be configured to engage tray 400, which may comprise back flap 404 and external protrusions 430, 432. FIG. 11 shows that the external protrusions 430, 432 are hinged down to be in position to engage with the internal protrusions of the sleeve.

Figure 12:
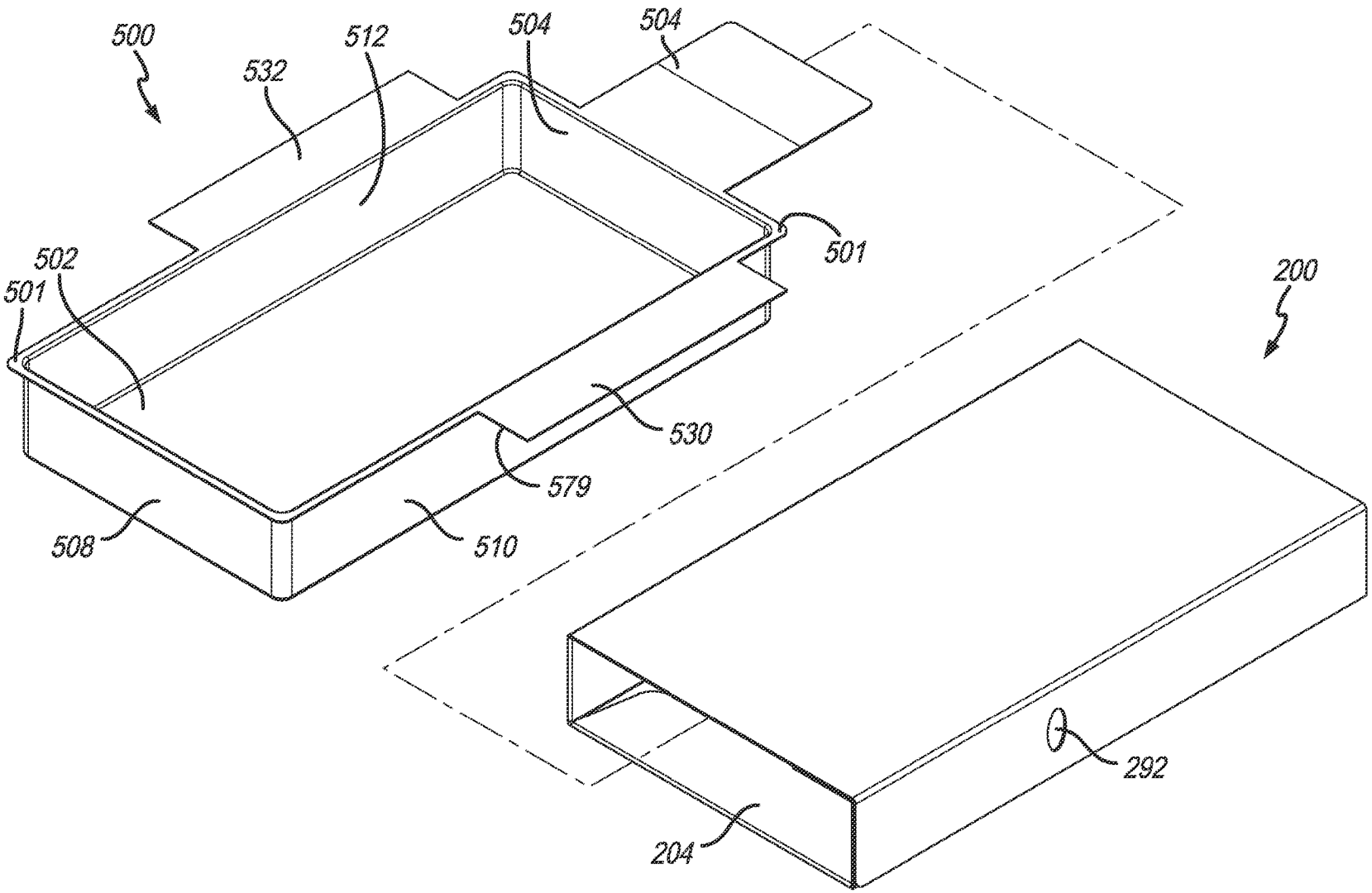
FIG. 12 is an illustration of a perspective view of another embodiment of a thermoformed tray and a sleeve.

FIG. 12 is an illustration of a perspective view of another embodiment of a thermoformed tray and a sleeve. FIG. 12 shows sleeve 200 may engage with tray 500, which may comprise bottom 502, lip 501, back flap 504, back end 506, front end 508, first side 510, second side 512, and external protrusions 530, 532. FIG. 12 shows that the back flap 504 may be hinged from the lip 501.

Figure 13:
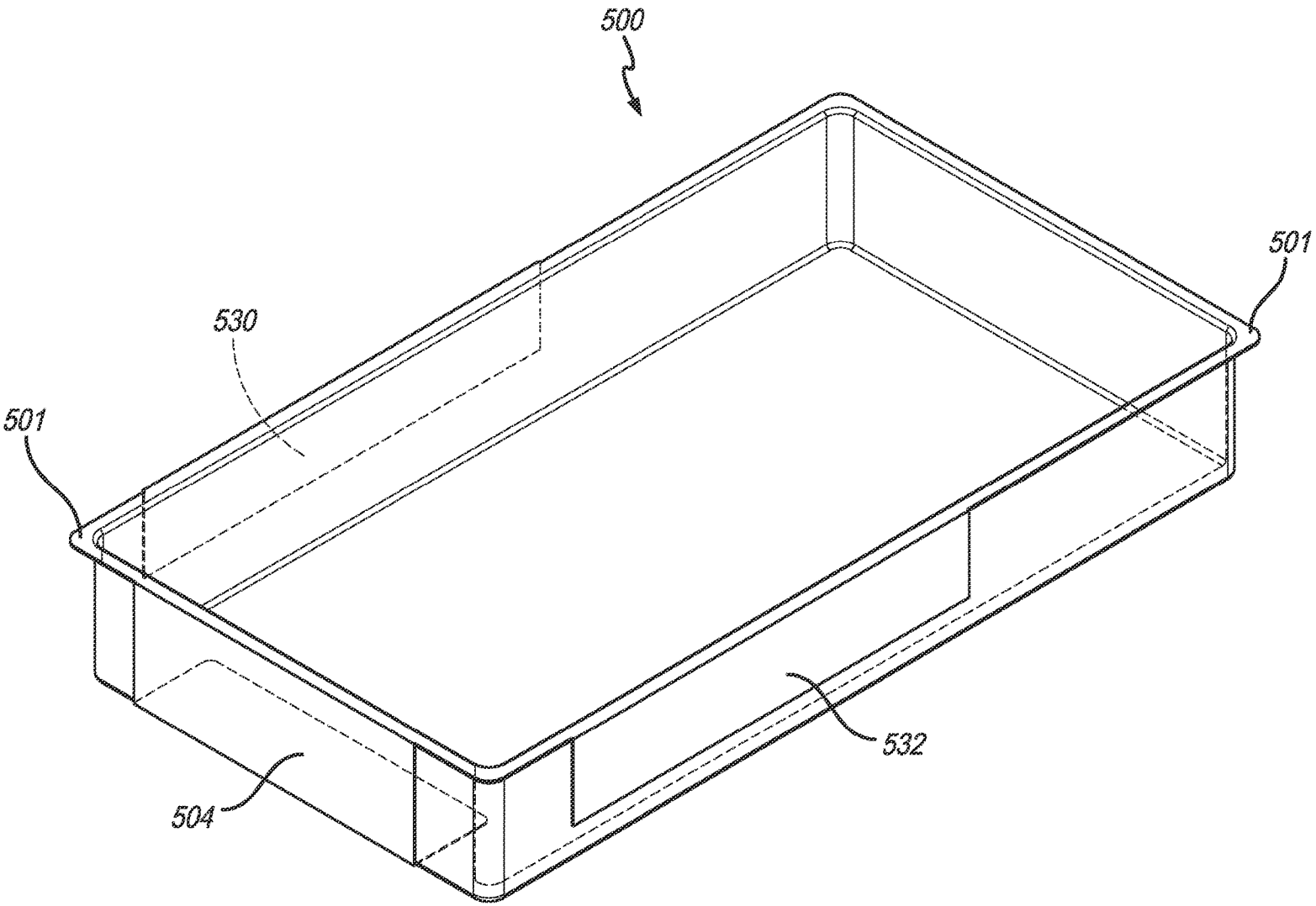
FIG. 13 is an illustration of a perspective view of the thermoformed tray.

FIG. 13 is an illustration of a perspective view of the thermoformed tray. FIG. 13 shows that tray 500 may comprise lip 501, back flap 504, and external protrusions 530, 532. FIG. 13 shows that the back flap 504 has been bent, or hinged, at the lip 501 and a second time at the bottom of the tray 500. In this manner, flap 504 is configured to engage with the front flap of the sleeve to prevent the tray 500 from completely being removed from the sleeve.

Figure 14:
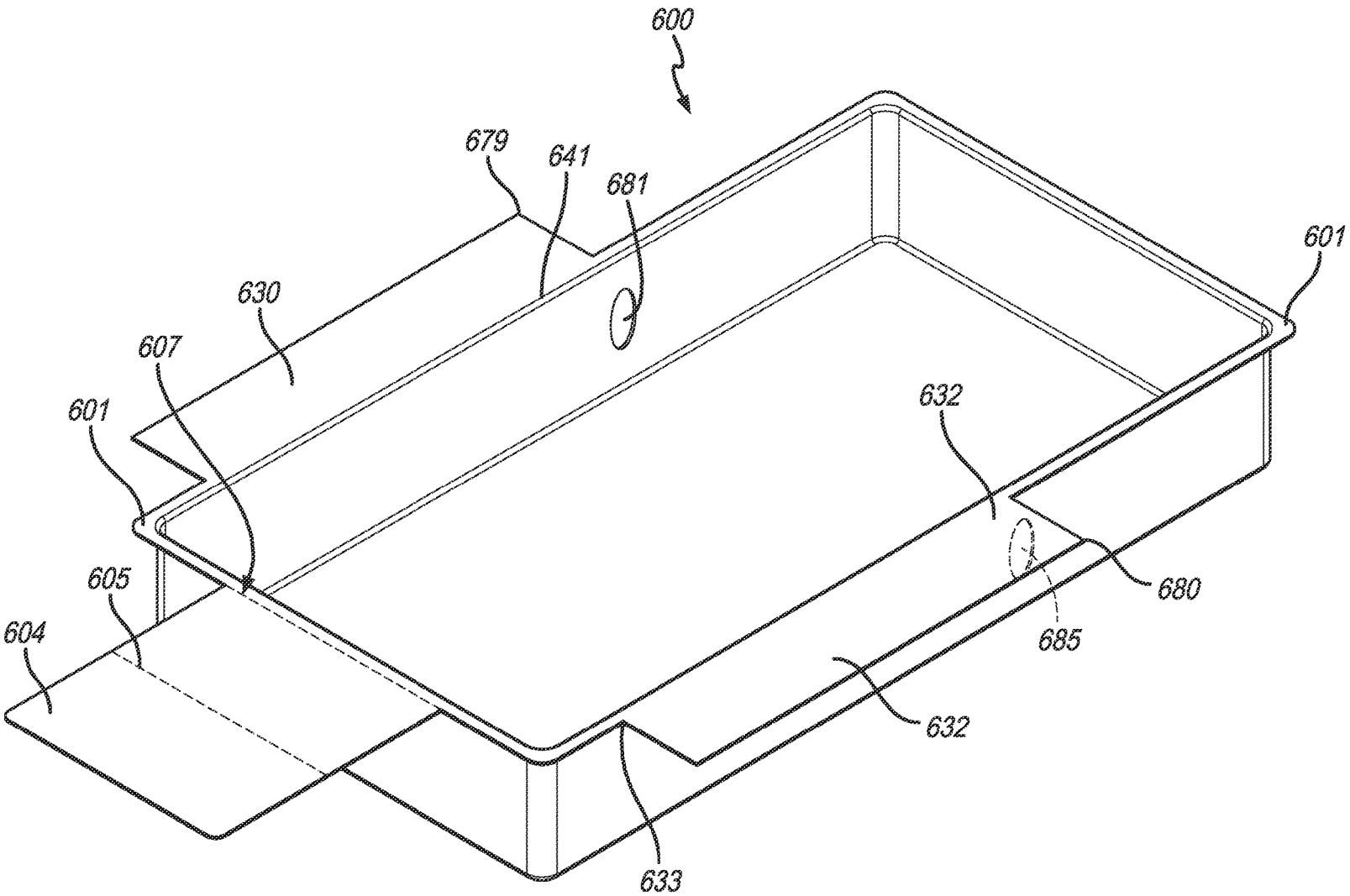
FIG. 14 is an illustration of a perspective view of another embodiment of a thermoformed tray.

FIG. 14 is an illustration of a perspective view of another embodiment of a thermoformed tray. FIG. 14 shows that tray 600, may comprise lip 601, back flap 604, external protrusions 630, 632, external protrusion ends 679, 680, and spacer holes 681, 685. FIG. 14 shows that the back flap 604 may have hinges 605, 607 at the lip 601 and at the bottom of the tray 600. Flap 604 is configured to engage with the front flap of the sleeve to prevent the tray 600 from completely being removed from the sleeve. FIG. 14 shows that the spacer holes 681, 685 may align or overlap with the ends 679, 680. The spacer holes 681, 685 may align or overlap with the access holes of the sleeve. In this manner, the user may access the ends 679, 680 and push them so that they disengage with the ends of the internal protrusions of the sleeve. This allows the user to prevent children from opening the container, but still access it without out a key lock. FIG. 14 shows that the external protrusions 630, 632 may have hinges 633, 641 at the lip 601.

In some embodiments the external and internal protrusions may have an inherent tension that pushes them toward them outward (external protrusions) or inward (internal protrusions), such that the engagement with the respective other protrusion is more secure and difficult to defeat. In other embodiments the protrusions may be made thicker in order to make the container more difficult to open. In other embodiments, the protrusions may have ends that are thinner or smoother, or have less tension or no tension (glued to the side), which makes the container easier to open. The exact shape, configuration, and materials that make up the protrusions may affect how child resistant the container might be.

Figure 15:
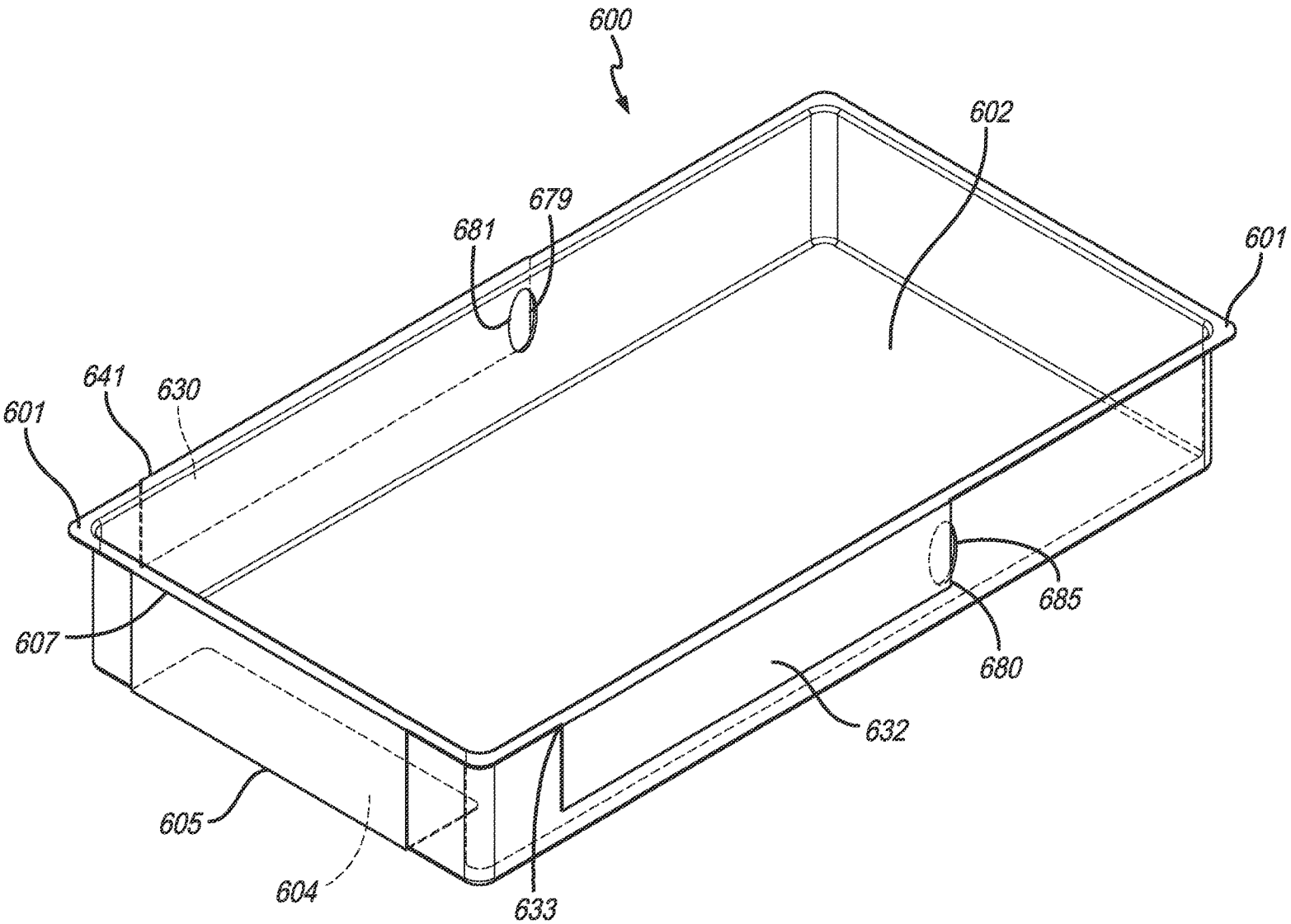
FIG. 15 is an illustration of a perspective view of the thermoformed tray.

FIG. 15 is an illustration of a perspective view of the thermoformed tray. FIG. 15 shows that tray 600, may comprise bottom 602, lip 601, back flap 604, external protrusions 630, 632, external protrusion ends 679, 680, and spacer holes 681, 685. FIG. 15 shows that the back flap 604 has been hinged 607 at the lip 601 and has been hinged 605 at the bottom 602 of the tray 600. In this manner, flap 604 is configured to engage with the front flap of the sleeve to prevent the tray 600 from completely being removed from the sleeve. FIG. 15 shows that the spacer holes 681, 685 may align or overlap with the ends 679, 680. The spacer holes 681, 685 may align or overlap with the access holes of the sleeve. In this manner, the user may access the ends 679, 680 and push them so that they disengage with the ends of the internal protrusions of the sleeve. This allows the user to prevent children from opening the container, but still access it without out a key lock. FIG. 15 shows that the external protrusions 630, 632 may hinge 633, 641 at the lip 601.

Figure 16:
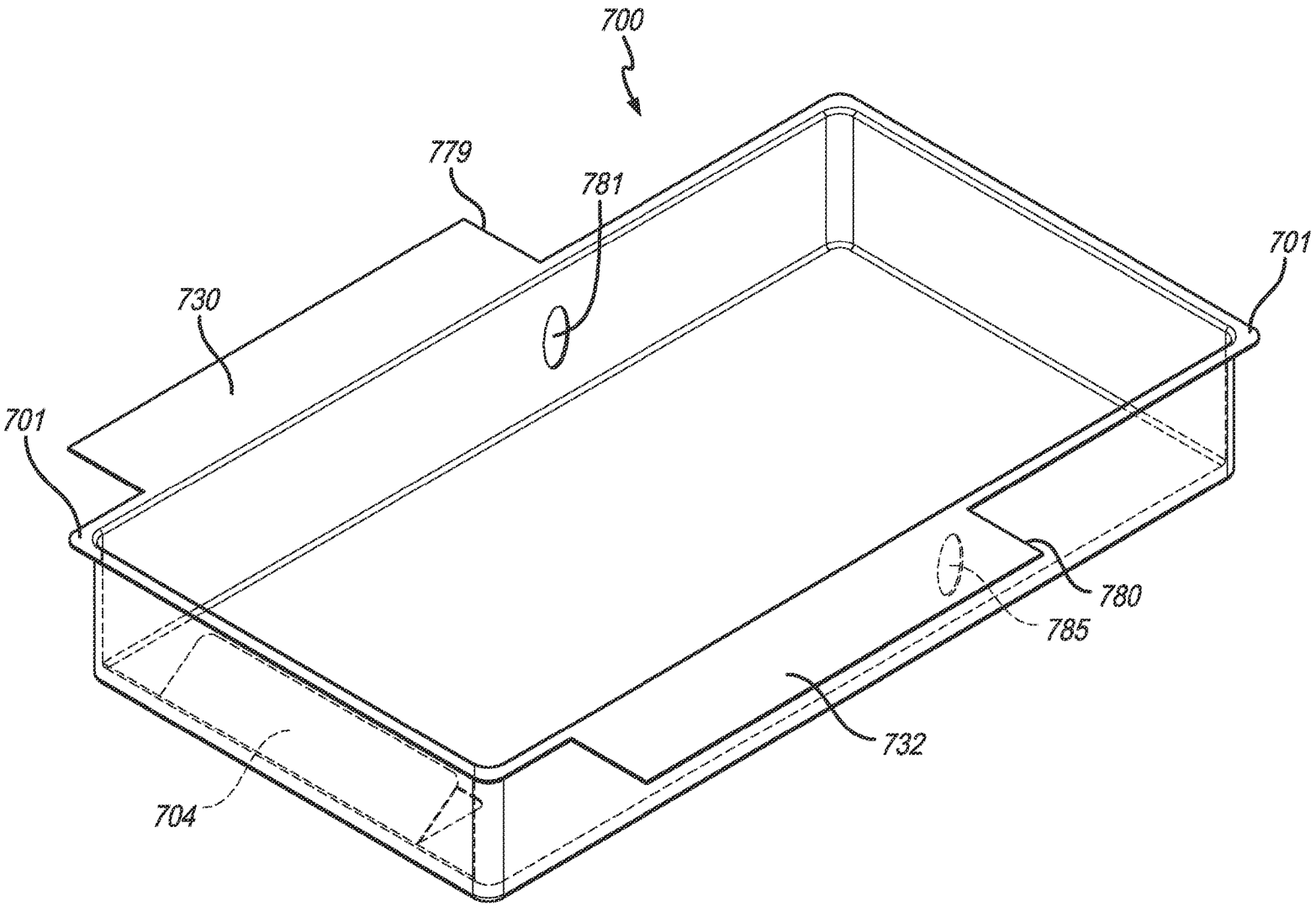
FIG. 16 is an illustration of a perspective view of the thermoformed tray.

FIG. 16 is an illustration of a perspective view of the thermoformed tray. FIG. 16 shows that tray 700, may comprise lip 701, back flap 704, external protrusions 730, 732, external protrusion ends 779, 780, and spacer holes 781, 785.

Figure 17:
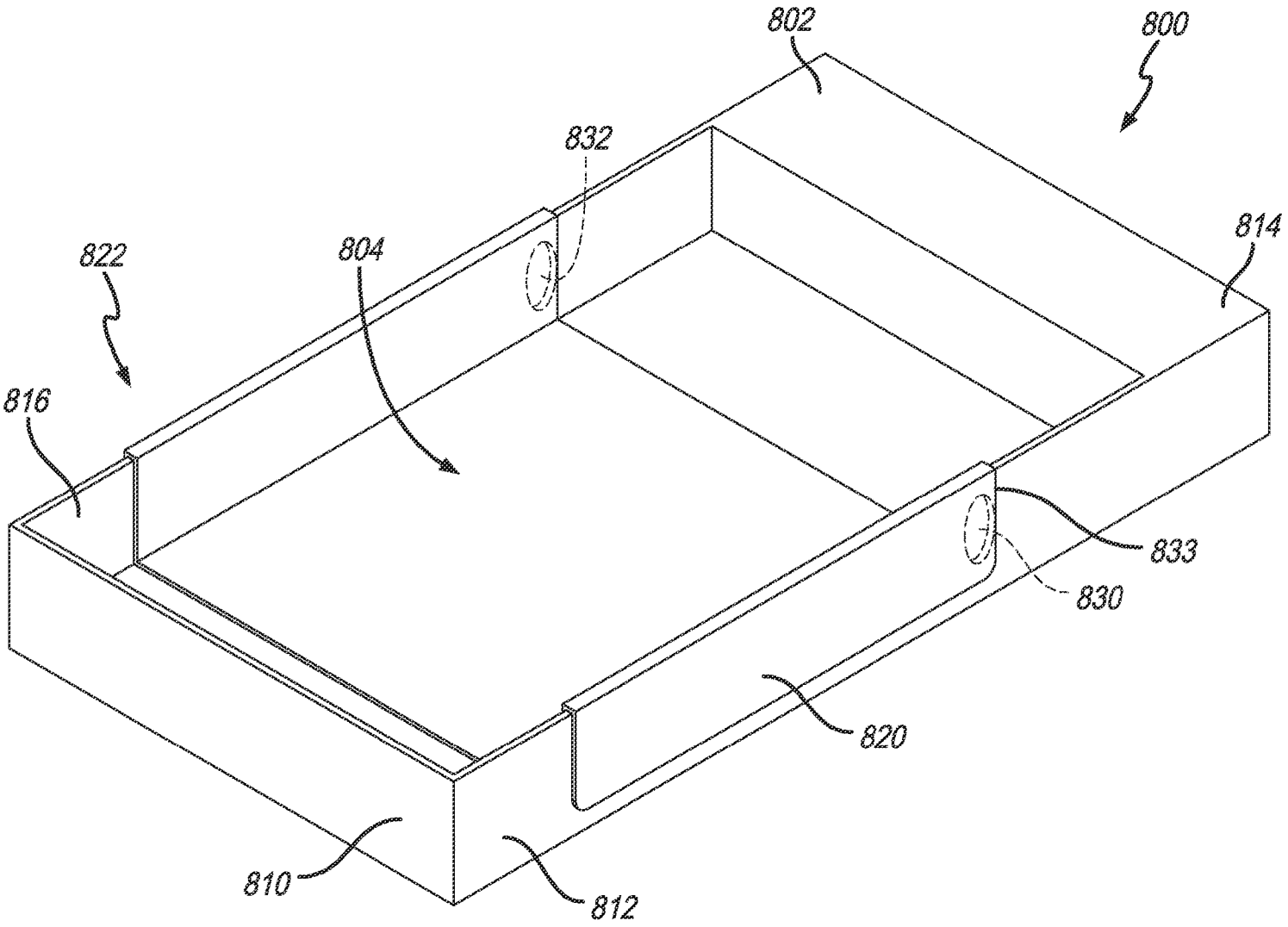
FIG. 17 is an illustration of a perspective view of one embodiment of a rigid tray.

FIG. 17 is an illustration of a perspective view of one embodiment of a rigid tray. FIG. 17 shows that tray 800 may comprise insert 804, rigid base 802, back end 810, front end 814, sides 812, 816, spacer holes 830, 832, external protrusions 820, 822, and external protrusion ends 833. As shown in FIG. 17, the rigid base may be constructed of rigid paper or cardboard and may be coated. The insert 804 is configured to matingly engage with the rigid base 802 and provide the external protrusions 820, 822. The insert 804 may rise from an interior of the rigid base 802 and may be removeably, or as preferred, permanently connected to the rigid base 802. The connection may typically be by an adhesive, but any connection device or mechanism may be used.

Figure 18:
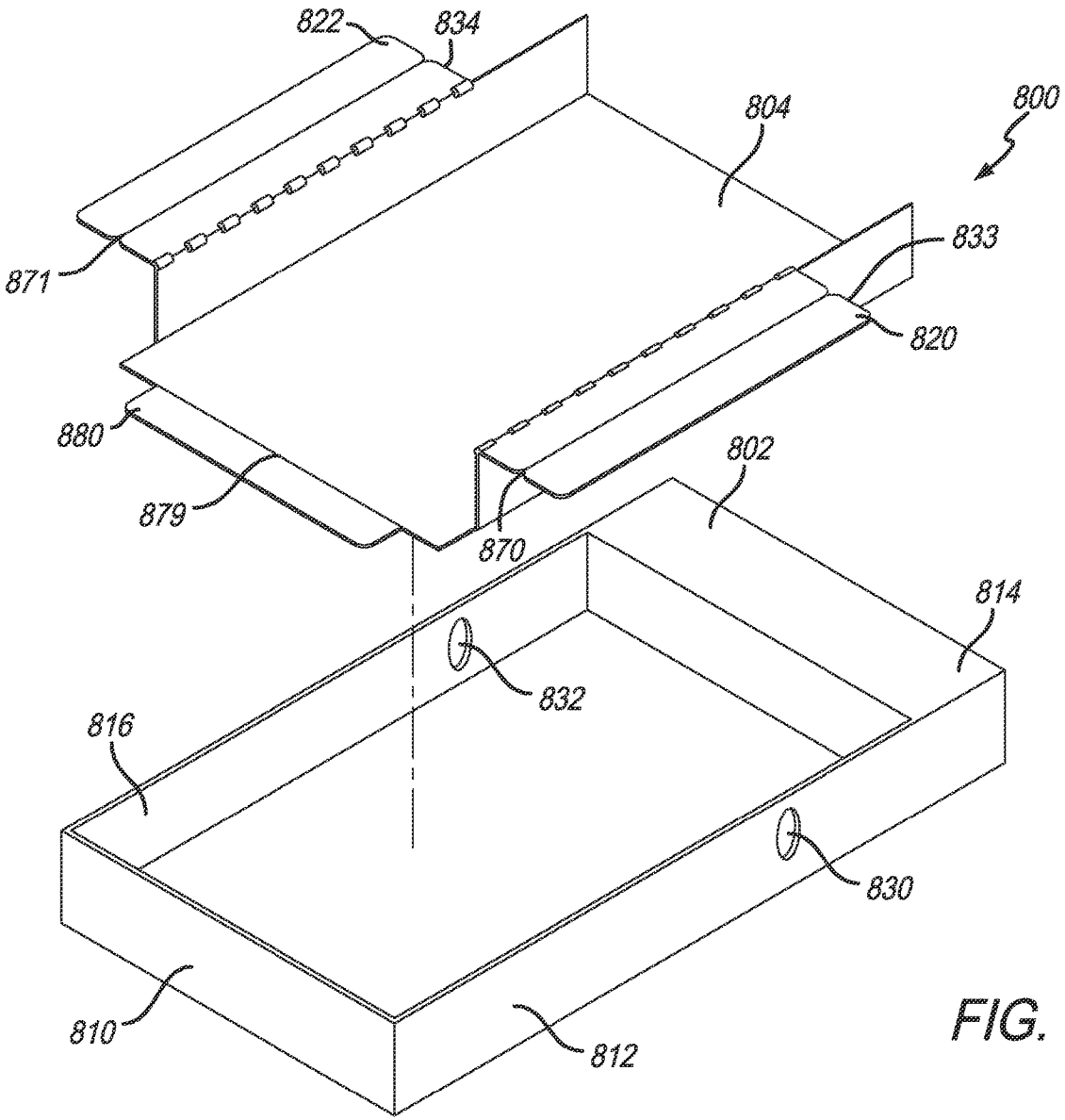
FIG. 18 is an illustration of an exploded view of the rigid tray.
Figure 21:
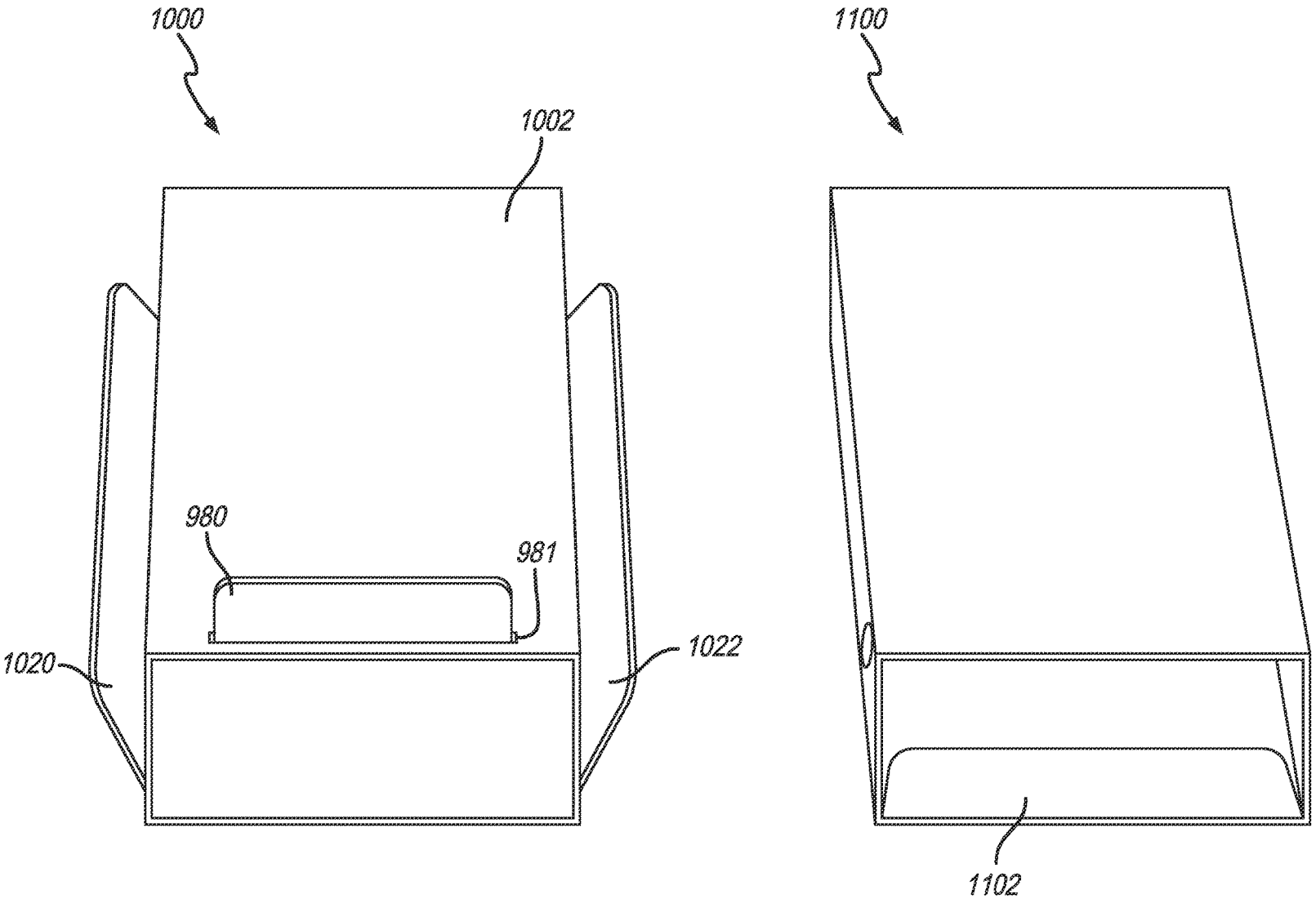
FIG. 21 is an illustration of a perspective view of the rigid tray and sleeve.

FIG. 18 is an illustration of an exploded view of the rigid tray. FIG. 18 shows that tray 800 may comprise an insert 804 and a rigid base 802. The rigid base may comprise back end 810, front end 814, sides 812, 816, and spacer holes 830, 832. The insert 804 may have external protrusions 820, 822, and external protrusion ends 833, 834. As shown in FIG. 18, the rigid base may be constructed of rigid paper or cardboard and may be coated. The external protrusion ends 833, 834 may align with or substantially overlap with spacer holes 830, 832. In this manner ends 833, 834 is more easily moved to a position where it is not hindered by the internal protrusions of the sleeve. The insert 804 is configured to matingly engage with the rigid base 802 and provide the external protrusions 820, 822. In one embodiment, the external protrusions 820, 822 may be made double thick by folding at crease, score, or hinges 870, 871. Once folded, the doubled over external protrusions 820, 822 may be connected or glued together to stay that way. FIG. 18 shows that the insert 804 may have a back flap 880 and hinge 879, which may be inserted through a slot in the bottom of the rigid tray 802, as shown in FIG. 21.

FIGS. 17 and 18 show that the insert 804 preferably may not have spacer holes. These are generally not needed or preferred on the insert because the walls of the rigid tray 802 are thick, such that the spacer holes 830, 832 provide sufficient additional room or space.

Figure 19:
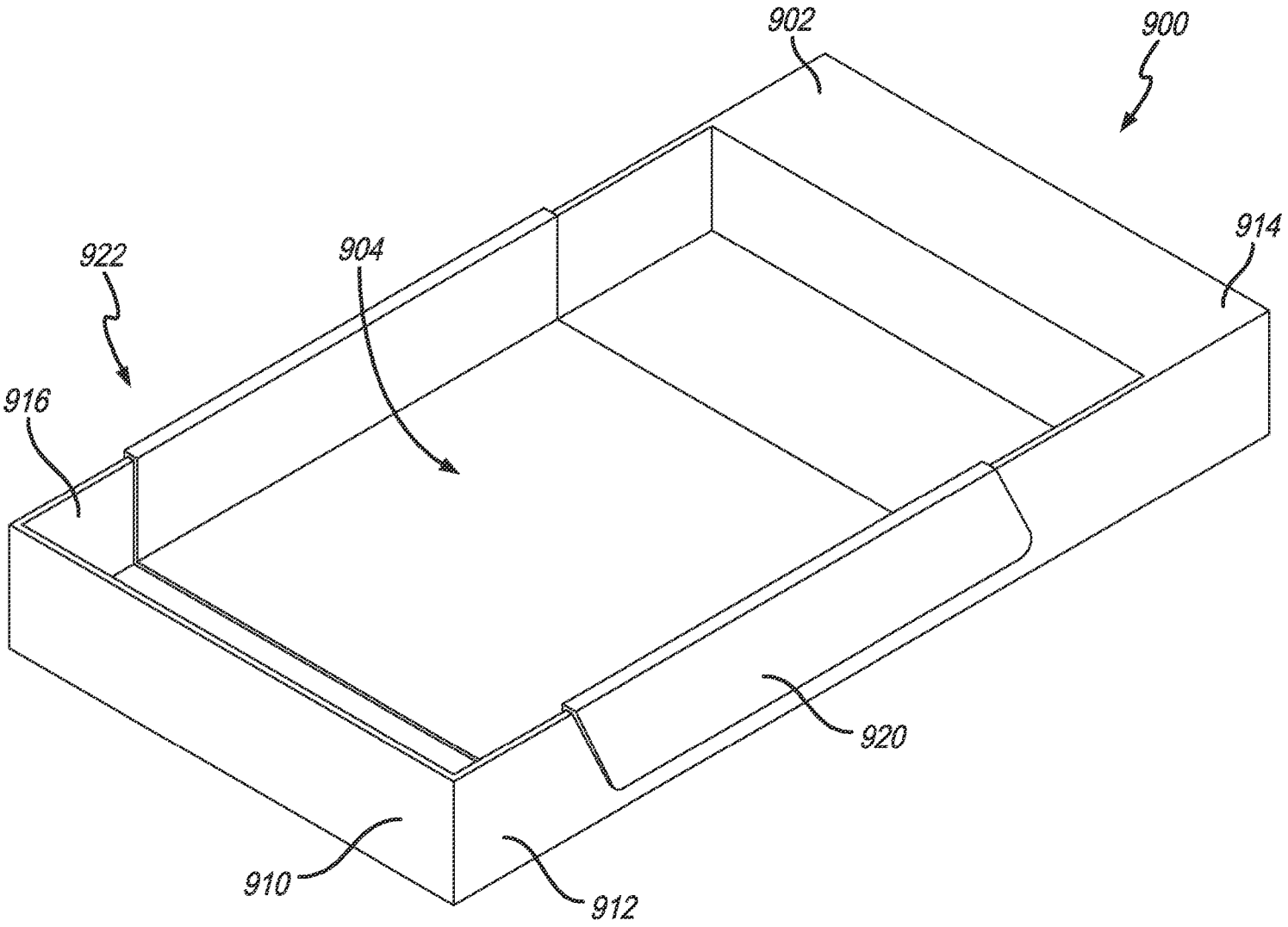
FIG. 19 is an illustration of a perspective view of another embodiment of a rigid tray.

FIG. 19 is an illustration of a perspective view of another embodiment of a rigid tray. FIG. 19 shows that tray 900 may comprise insert 904, rigid base 902, back end 910, front end 914, sides 912, 916, and external protrusions 920, 922. The tray 900 is essentially the same as tray 800 shown in FIG. 17, but without the spacer holes.

Figure 20:
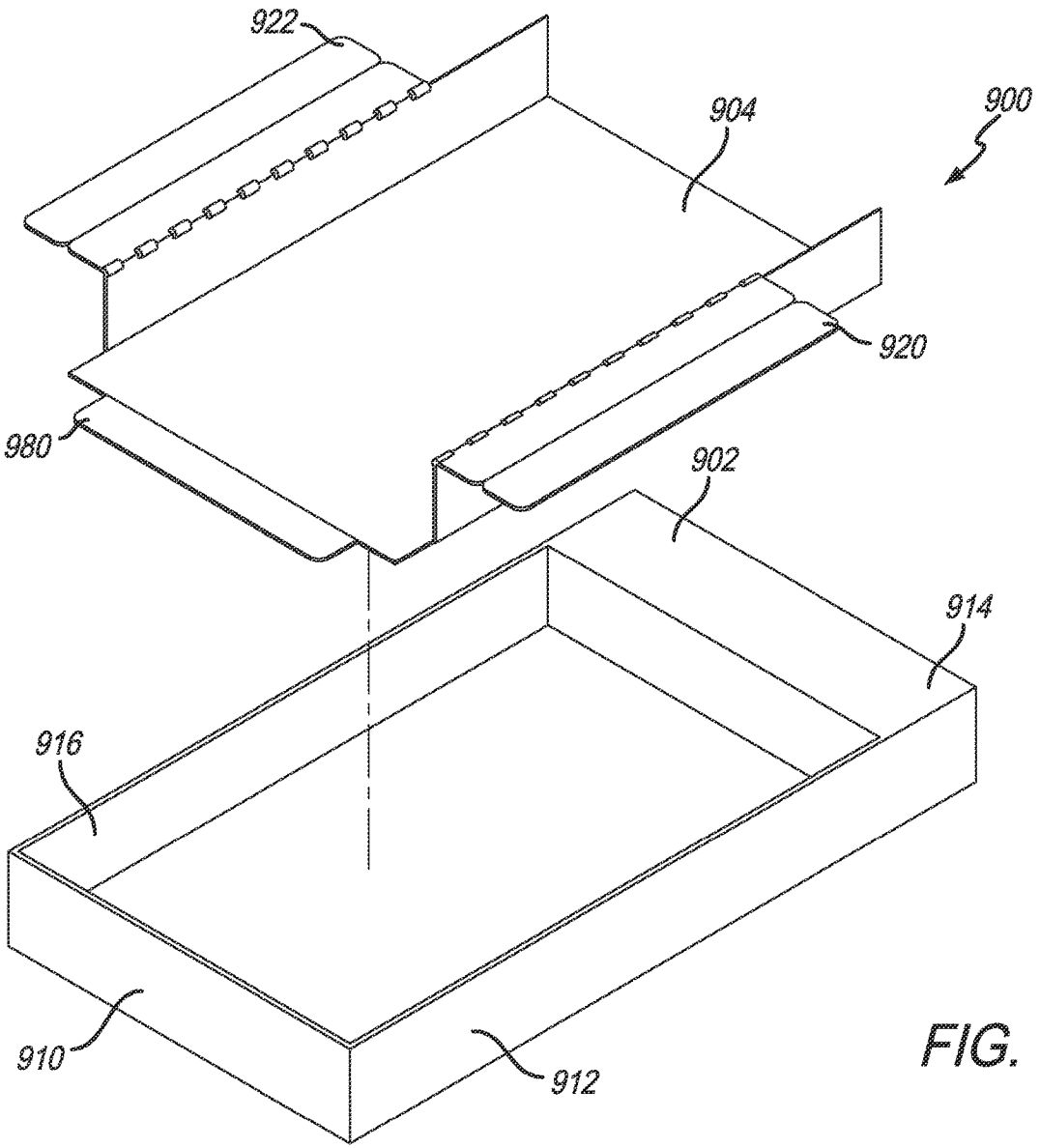
FIG. 20 is an illustration of an exploded view of the rigid tray.

FIG. 20 is an illustration of an exploded view of the rigid tray. FIG. 19 shows that tray 900 may comprise an insert 904 and a rigid base 902. The insert 804 may comprise external protrusions 920, 922 and back flap 980. The tray 900 is essentially the same as tray 800 shown in FIG. 18, but without the spacer holes.

FIG. 21 is an illustration of a perspective view of a tray and a sleeve. FIG. 21 shows that the tray may comprise a rigid base 1002, insert protrusions 1020, 1022, and back flap 980. back flap 980 may extend through slot 981 and may be configured to engage with front flap 1102 of sleeve 1100, such that the tray 1000 is generally prevented from being entirely removed from the sleeve 1100.

The foregoing description of the preferred embodiment has been presented for the purposes of illustration and description. While multiple embodiments are disclosed, still other embodiments will become apparent to those skilled in the art from the above detailed description, which shows and describes the illustrative embodiments. As will be realized, these embodiments are capable of modifications in various obvious aspects, all without departing from the spirit and scope of the present disclosure. Accordingly, the detailed description is to be regarded as illustrative in nature and not restrictive. Also, although not explicitly recited, one or more additional embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A child-resistant package, comprising:

a tray;

a sleeve;

wherein said tray is configured to be inserted into said sleeve;

wherein said rigid base comprises one or more sides wherein said sleeve comprises one or more internal protrusions and one or more access holes;

wherein said tray comprises an insert and a rigid base;

wherein said insert comprises one or more external protrusions;

wherein said insert is configured to matingly engage with said rigid base, such that said one or more external protrusions are external to said one or more sides of said rigid base;

wherein said one or more internal protrusions are configured to engage with said one or more external protrusions when said tray and said sleeve are in a closed position, such that said tray is substantially prevented from being taken out of said closed position without disengaging said one or more external protrusions from said one or more internal protrusions; and wherein each of said one or more access holes overlap with an end of each of said one or more external protrusions, such that a user may access and disengage said one or more external protrusions from said one or more internal protrusions, such that said tray is no longer prevented from being taken out of said closed position.

2. The child-resistant package of claim 1, wherein said rigid base of said tray further comprises one or more spacer holes;

wherein said one or more spacer holes overlap with both said one or more ends of said external protrusions and said one or more access holes.

3. The child-resistant package of claim 2, wherein said insert further comprises a back flap that is configured to pass through a slot of said rigid base;

wherein said sleeve further comprises a front flap; and wherein said front flap and said back flap are configured to engage with each other, such that said tray is substantially prevented from being entirely removed from said sleeve.

4. The child-resistant package of claim 3, wherein said one or more external protrusions each comprise a hinge, such that said one or more external protrusions are configured to be folded at said hinge to make the external protrusions double thick.

5. The child-resistant package of claim 4, wherein said back flap comprises a hinge that is configured to enable said back flap to pass through said slot of said rigid base.

6. A child-resistant package, comprising:

a tray;

a sleeve;

wherein said tray is configured to be inserted into said sleeve;

wherein said rigid base comprises one or more sides wherein said sleeve comprises one or more internal protrusions and one or more access holes;

wherein said tray comprises an insert and a rigid base;

wherein said insert comprises one or more external protrusions;

wherein said insert is configured to matingly engage with said rigid base, such that said one or more external protrusions are external to one said or more sides of said rigid base;

wherein said one or more internal protrusions are configured to engage with said one or more external protrusions when said tray and said sleeve are in a closed position, such that said tray is substantially prevented from being taken out of said closed position without disengaging said one or more external protrusions from said one or more internal protrusions;

wherein each of said one or more access holes overlap with an end of each of said one or more external protrusions, such that a user may access and disengage said one or more external protrusions from said one or more internal protrusions, such that said tray is no longer prevented from being taken out of said closed position; and wherein said one or more external protrusions each comprise a hinge, such that said one or more external protrusions are configured to be folded at said hinge to make the external protrusions double thick.

7. The child-resistant package of claim 6, wherein said rigid base of said tray further comprises one or more spacer holes;

wherein said one or more spacer holes overlap with both said one or more ends of said external protrusions and said one or more access holes.

8. The child-resistant package of claim 6, wherein said insert further comprises a back flap that is configured to pass through a slot of said rigid base;

wherein said sleeve further comprises a front flap; and wherein said front flap and said back flap are configured to engage with each other, such that said tray is substantially prevented from being entirely removed from said sleeve.

9. The child-resistant package of claim 7, wherein said insert further comprises a back flap that is configured to pass through a slot of said rigid base;

wherein said sleeve further comprises a front flap; and wherein said front flap and said back flap are configured to engage with each other, such that said tray is substantially prevented from being entirely removed from said sleeve.

10. The child-resistant package of claim 9, wherein said back flap comprises a hinge that is configured to enable said back flap to pass through said slot of said rigid base.

11. A child-resistant package, comprising:

a tray;

a sleeve;

wherein said tray is configured to be inserted into said sleeve;

wherein said rigid base comprises one or more sides wherein said sleeve comprises one or more internal protrusions and one or more access holes;

wherein said tray comprises an insert and a rigid base;

wherein said insert comprises one or more external protrusions;

wherein said insert is configured to matingly engage with said rigid base, such that said one or more external protrusions are external to said one or more sides of said rigid base;

wherein said one or more internal protrusions are configured to engage with said one or more external protrusions when said tray and said sleeve are in a closed position, such that said tray is substantially prevented from being taken out of said closed position without disengaging said one or more external protrusions from said one or more internal protrusions;

wherein each of said one or more access holes overlap with an end of each of said one or more external protrusions, such that a user may access and disengage said one or more external protrusions from said one or more internal protrusions, such that said tray is no longer prevented from being taken out of said closed position;

wherein said rigid base of said tray further comprises one or more spacer holes;

wherein said one or more spacer holes overlap with both said one or more ends of said external protrusions and said one or more access holes; and wherein said one or more external protrusions each comprise a hinge, such that said one or more external protrusions are configured to be folded at said hinge to make the external protrusions double thick.

12. The child-resistant package of claim 11, wherein said insert further comprises a back flap that is configured to pass through a slot of said rigid base;

wherein said sleeve further comprises a front flap; and wherein said front flap and said back flap are configured to engage with each other, such that said tray is substantially prevented from being entirely removed from said sleeve.

13. The child-resistant package of claim 12, wherein said back flap comprises a hinge that is configured to enable said back flap to pass through said slot of said rigid base.

* * * * *